United States Patent [19]

Abraham

[11] Patent Number: 4,565,232

[45] Date of Patent: Jan. 21, 1986

[54] FOUNDRY SAND MOLDING APPARATUS

[76] Inventor: Edward D. Abraham, 6695 Farview Rd., Brecksville, Ohio 44140

[21] Appl. No.: 535,932

[22] Filed: Sep. 26, 1983

Related U.S. Application Data

[63] Continuation of Ser. No. 176,981, Aug. 11, 1981, abandoned.

[51] Int. Cl.[4] ..... B22C 15/30; B22C 17/00

[52] U.S. Cl. ..... 164/181; 164/183; 164/197; 164/207; 164/224

[58] Field of Search ..... 164/181, 183, 184, 185, 164/200, 205, 207, 209, 210, 224, 195, 196, 197

[56] References Cited

U.S. PATENT DOCUMENTS 2,624,084 1/1953 Row ..... 164/185
3,181,207 5/1965 Schaible et al. ..... 164/181
3,406,738 10/1968 Hunter ..... 164/138
4,044,818 8/1977 Larkin ..... 164/183

FOREIGN PATENT DOCUMENTS 2452204 1/1976 Fed. Rep. of Germany ..... 164/185

*Primary Examiner*—Nicholas P. Godici
*Assistant Examiner*—Richard K. Seidel
*Attorney, Agent, or Firm*—Yount & Tarolli

[57] ABSTRACT

Foundry sand molding apparatus for simultaneously forming cope and drag molds. The cope and drag molds are substantially simultaneously pre-jolted and jolt-squeezed to assure uniform density in the molds. Thereafter the apparatus laterally transfers the cope and drag molds into vertical alignment at an assembly station, with the drag mold being inverted and lowered during lateral transfer of same.

8 Claims, 8 Drawing Figures

FOUNDRY SAND MOLDING APPARATUS

This is a continuation of application Ser. No. 176,981 filed Aug. 11, 1981, now abandoned.

BACKGROUND OF THE INVENTION

The present invention relates to foundry equipment for making molds, and more particularly to a flaskless mold-making machine capable of making cope molds and drag molds simultaneously and also capable of applying a pre-jolt and a jolt-squeeze to both of the mold sections. Further, the machine constructed according to the present invention moves the cope and drag mold sections into vertical alignment with each other and strips them from the flasks, returning the flasks for use in making succeeding molds.

In the foundry industry, various machines for manufacturing molds are known. These devices generally include an overhead supply of molding sand, a chute for delivering the sand in premeasured quantities into a mold flask, and some means for compacting the sand in the mold. Also associated with these machines is a device for extracting or stripping finished molds from the flasks in which they were formed and positioning the completed mold ready for the next operation.

In a matchplate mold-making machine the mold is formed by performing the following steps. First, the matchplate is inverted so that the drag side is facing up. Sand is poured into a flask whose bottom is formed by the drag portion of the matchplate. This sand is then pre-jolted and jolt-squeezed to form the drag section of the mold. The pre-jolt and jolt-squeeze may be accomplished by using known devices such as that disclosed in U.S. Pat. No. 3,658,118 or other similar arrangements.

When the drag mold section has been formed the matchplate with the drag section connected with it is turned right side up and sand is poured into the cope side where it is squeezed to form the cope section of the mold. It is not practical to both pre-jolt the cope section of the mold and jolt-squeeze the cope section in practice for a number of reasons. In fact, applicant knows of no matchplate machine which both pre-jolts and jolt-squeezes the cope.

Known mold-making macines may be distiguished on the basis of the number of flasks used in the mold-making process. One type utilizes a large number of flasks in which the sand is poured to form a mold. In machines of this type, one flask from the supply of flasks is fed into the machine where it is filled with sand, and then the flask and sand together are moved to the next operation. Eventually, the mold is stripped from the flask and the flask is returned to the supply.

A second type of mold-making equipment is called flaskless because it does not utilize a large supply of flasks. Instead, the same flask is used to make each mold. In a machine of this type the flask is filled with sand, and the sand is compacted to form a mold. Thereafter, the completed mold is extracted from the flask and the mold alone sent on for further processing. The flask, however, is returned immediately to be refilled with sand to make the next mold.

In addition, mold-making machines are known which sequentially form cope and drag molds, and then assemble them at an assembly station. Moreover, it is also known to form cope and drag mold sections in a separate apparatus and then to assemble them in an assembly apparatus.

SUMMARY OF THE INVENTION

The present invention provides a mold-making machine in which cope and drag mold sections are formed simultaneously at adjacent molding stations. Both the cope and drag mold sections are pre-jolted during filling with sand and jolt-squeezed thereafter to form the respective mold sections. The cope and drag mold sections and the flasks in which they are formed are moved to a stripping station where the cope and drag mold sections are assembled and removed from the flasks. The flasks are then returned to the cope and drag molding stations to produce the succeeding molds.

The molding apparatus of the present invention makes cope and drag molds substantially simultaneously at their respective molding stations. This enables the machine of the present invention to produce complete molds faster than matchplate machines. The pre-jolting and jolt-squeezing of both the cope and drag mold sections means the molds produced are more uniform in density and produce better castings than molds where only the drag of the completed mold has been prejolted.

The molding apparatus of the present invention transfers the cope and drag mold sections laterally into vertical alignment with each other at a stripping station after they have been jolt-squeezed. Since the drag mold is upside down during the filling and packing with sand, it must be turned over prior to assembly with the cope mold section. The present invention automatically inverts the drag mold during transfer of the drag mold from the drag molding station to the stripping station. Further, the present invention also lowers the drag mold to a convenient position for placing cores within it while the cope remains out of the way allowing the operator complete visual access.

In one arrangement, cope and drag flask holding means are provided for holding cope and drag flasks in which the molds are formed and transferred from one station to another. The holding means is supported for lateral movement from the respective molding stations to the stripping station where the molds are stripped from the flasks and assembled. The molding apparatus moves the drag flask molding means downwardly in an arcurate path while simultaneously rotating and inverting the drag flask molding means during movement from the drag molding station to the stripping station.

The drag flask holding means is supported on pivoted link means for swinging the drag flask holding means in an arcuate path from the drag molding station to the stripping station. Operating means operate in response to swinging movement of the link means for rotatably inverting the drag flask holding means.

The drag flask holding means includes movable upper and lower fingers for holding a drag flask therein. At the drag molding station, the upper fingers are clear of the drag flask while the lower fingers support it. When the drag flask holding means is moved to the stripping station and rotatably inverted, the positions of the fingers are reversed.

The cope and drag flask holding means are simultaneously moved from the molding stations toward the stripping station. The drag flask holding means is moved from the drag molding station to the stripping station, while the cope flask holding means moves from the cope molding station to an intermediate position located intermediate the cope molding station and the stripping station allowing complete access for placing cores in the drag. The cope flask holding means is then moved from its intermediate position into a position vertically aligned above the drag flask holding means at the stripping station. The cope and drag flasks are stripped of their molds and are assembled together at the stripping station. The flask holding means and their flasks are then returned to the molding station, and the entire process is repeated.

BRIEF DESCRIPTION OF THE DRAWINGS

These and other features and advantages of the present invention will become more apparent upon reading the following specification together with the accompanying drawings in which.

DESCRIPTION OF A PREFERRED EMBODIMENT

Figure 1:
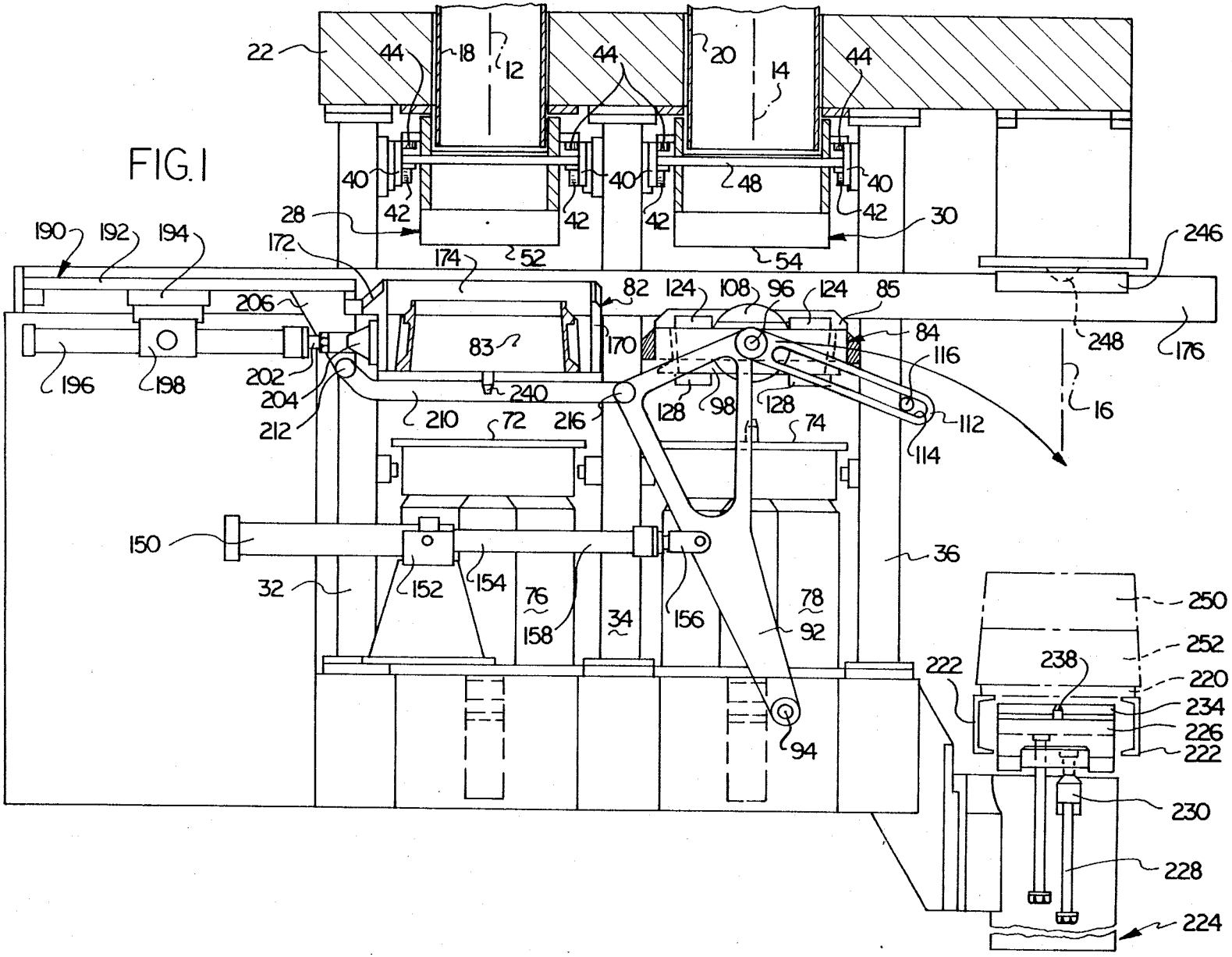
FIG. 1 is a partly sectioned side elevational view of an improved apparatus constructed in accordance with the present application.

A cope molding station shown in FIG. 1 is generally indicated by centerline 12, a drag molding station is generally indicated by centerline 14, and a mold assembly and stripping station is generally indicated by centerline 16. The stations 12, 14 and 16 are laterally spaced from one another, with the centerlines thereof lying in a common vertical plane. The cope molding station 12 is located on the opposite side of the drag molding station 14 from the assembly and stripping station 16.

A sand hopper 18, 20 is supported on an upper portion of the apparatus frame 22 at each molding station 12, 14. A movable carriage 28, 30 is suppoted beneath each sand hopper 18, 20 on the apparatus upright frame members 32, 34 and 36. Generally horizontally extending opposed pairs of parallel rails 40 are suitably secured to the frame members 32–36 for movably supporting the carriages 28, 30. The rails 40 are elongated in a direction perpendicular to the plane of the paper in FIG. 1. Support rollers 42 are mounted on horizontal axes to the rails 40 and are spaced apart therealong in a direction perpendicular to the plane of the paper in FIG. 1. Upper guide rollers 44 are secured to the carriages 28, 30 on vertical axes and are spaced therealong in a direction perpendicular to the plane of the paper for engaging the rails 40 and transversely guiding the carriages 28, 30 during movement thereof. The carriages 28, 30 have carriage plates 48 supported on the support rollers 42 for rolling movement therealong.

Figure 4:
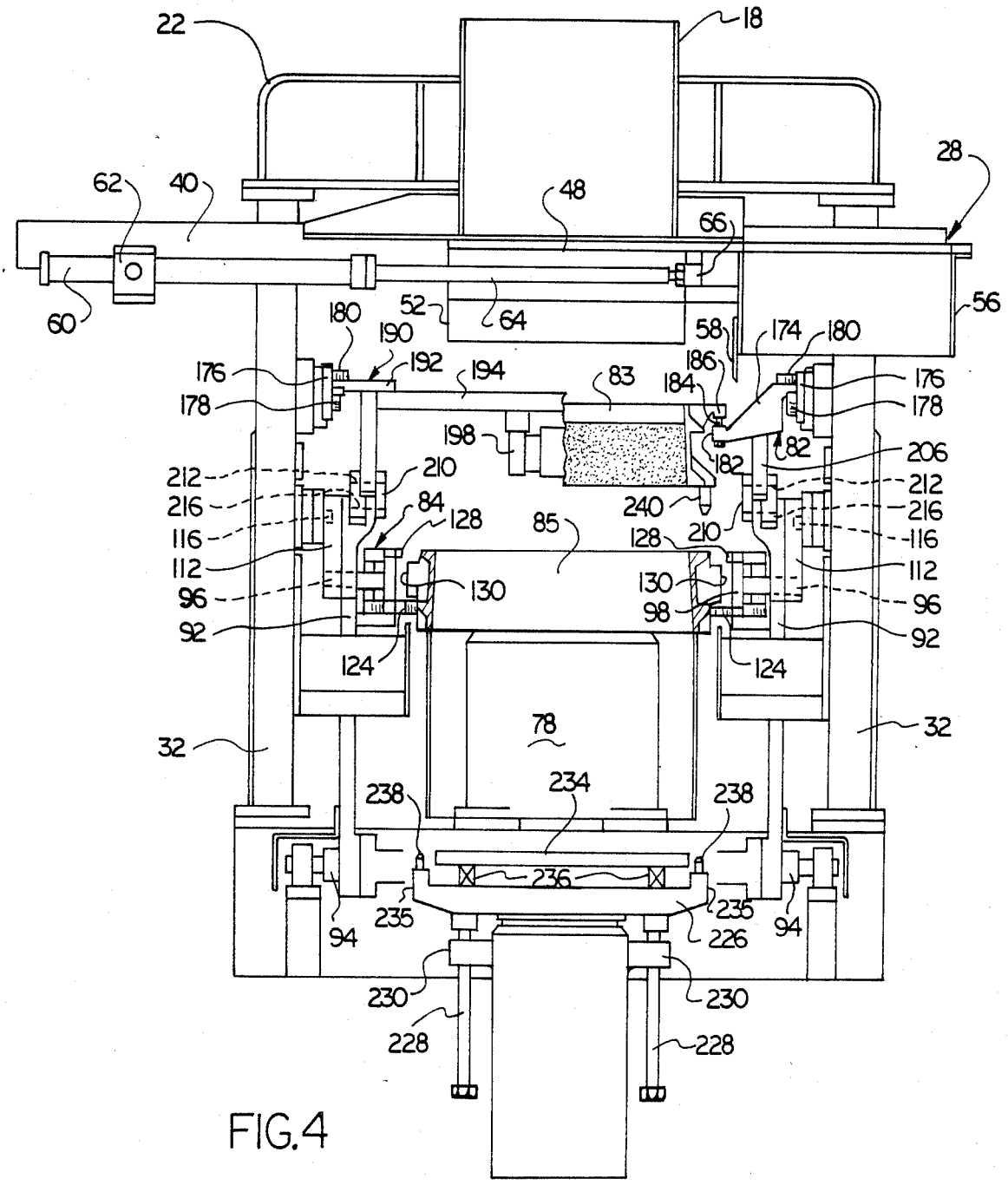
FIG. 4 is a partly sectional front elevational view of the apparatus of FIGS. 1–3.
Figure 5:
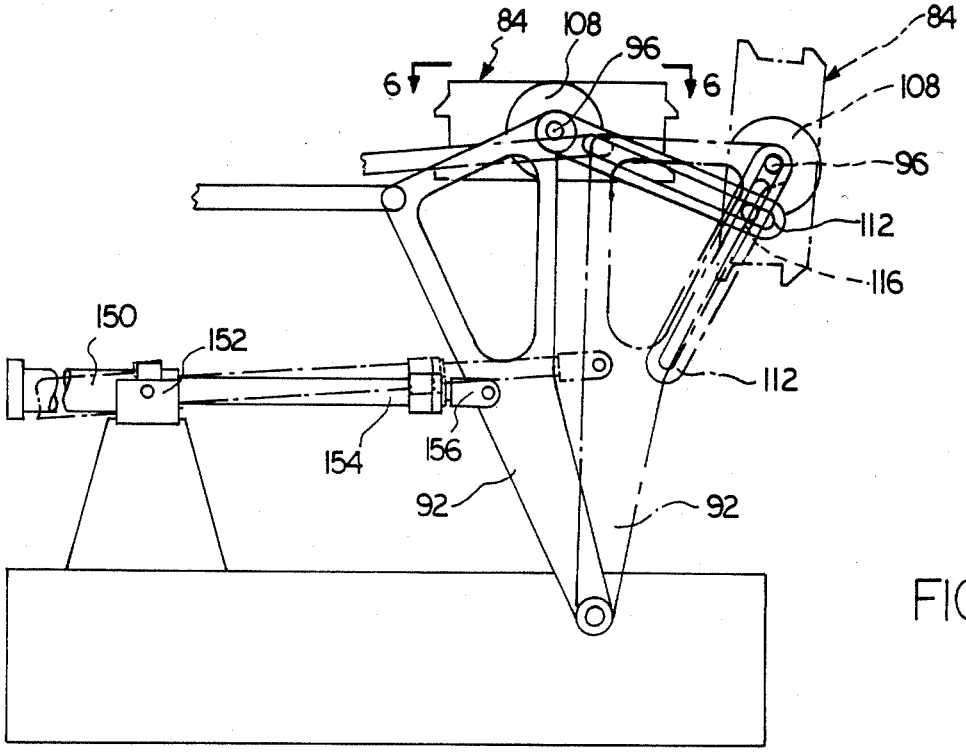
FIG. 5 is a side elevational view showing a pivoted link of the apparatus shown in FIGS. 1–4, the link being shown in a retracted position with solid lines and in an intermediate position of travel with phantom lines.

Each of the carriages 28, 30 has a squeeze board 52, 54 thereon. With reference to FIG. 4, each carriage also has a sand chute thereon and only the chute 56 for the carriage 28 is shown. Between the chute 56 and the squeeze board 52 is a strike-off member 58. In FIG. 4, power means for reciprocating the carriage 28 from left to right, and from right to left along the rails 40, is in the form of a fluid cylinder 60 having its cylinder portion suitably pivotally secured to the rail 40 as at 62, and having its rod 64 suitably secured to the plate 48 as at 66. A cylinder similar to the cylinder 60 is provided to move the carriage 30 along the rails 40.

The cylinder 60 is operated to retract the rod 64 and to move the carriage plate 48 to the left as viewed in FIG. 4 until the sand chute 56 is aligned beneath the sand hopper 18. A premeasured amount of sand then falls from the hopper 18 through the chute 56 to a cope flask 83 supported beneath the chute 56. The cylinder 60 is then operated to extend the cylinder rod 64, and this moves the carriage plate 48 to the right to carry the sand chute 56 from its position beneath the sand hopper 18 back to the position shown in FIG. 4, and to simultaneously carry the squeeze board 52 into a vertically aligned position beneath the hopper 18 and above the flask. During movement of the carriage 28 from left to right, the strike-off member 58 levels the sand which was supplied to the flask. Both of the carriages 28, 30 operate in the same manner at the cope and drag molding stations 12, 14, respectively.

Pattern and mold support tables 72, 74 (FIG. 1) are supported at the cope and drag molding stations 12, 14 on squeeze and jolt cylinders 76, 78. Cylinders of this type are well known. Suitable cylinders are shown in U.S. Pat. No. 3,916,983 issued Nov. 4, 1975 to Edward D. Abraham. The cylinders 76, 78 provide a "pre-jolt" to the sand as it fills the flask and for a short time thereafter. Further, the cylinders 76, 78 provide a simultaneous jolt and squeeze to pack the sand to the desired density. The pattern and mold support tables 72 and 74, and their respective fluid cylinders 76 and 78, are of any suitable known type, such as the type disclosed in the above mentioned U.S. Pat. No. 3,916,983.

A cage generally indicated at 82 defines a cope flask holding means for holding a cope flask 83 at the cope molding station 12. Another cage generally indicated at 84 defines a drag flask holding means for holding a drag flask 85 at the drag molding station 14. The cope and drag flask holding means 82, 84 support their respective cope and drag flasks 83, 85 for allowing upward movement of such flasks relative to their holding means.

In order to form cope and drag molds, the squeeze and jolt cylinders 76, 78 are operated for elevating the tables 72, 74 until the cope and drag flasks 83, 85 are supported thereon. Patterns supported on the tables 72, 74 will then be positioned within the cope and drag flasks 83, 85. The carriages 28, 30 are then operated in the previously described manner to fill the flasks 83, 85 with sand and to strike them off. During filling and strike off the cylinders 76, 78 jolt the sand to assure complete filling and prehardening or compacting of sand in each flask 83, 85. The squeeze and jolt cyliners 76, 78 then elevate the flasks 83, 85 upwardly to compact the sand therein against the squeeze boards 52, 54. By applying simultaneously an upward jolt to the sand and squeezing it against the squeeze boards 52, 54 the jolt cylinders 76, 78 thoroughly compact the sand within the flasks to form self-sustaining sand molds. The squeeze and jolt cylinders 76, 78 are then lowered to bring the tables 72, 74 back down to the positions shown in FIG. 1. This leaves the flasks 83, 85 containing finished sand molds suspended by the holding means 82, 84.

Support means is provided for supporting the cope and drag flask holding means 82, 84 for movement from the cope and drag molding stations 12, 14 to the assembly and stripping station 16. This support means may take many different forms, and an example of one illustrative type of support means will be described in detail.

Figure 2:
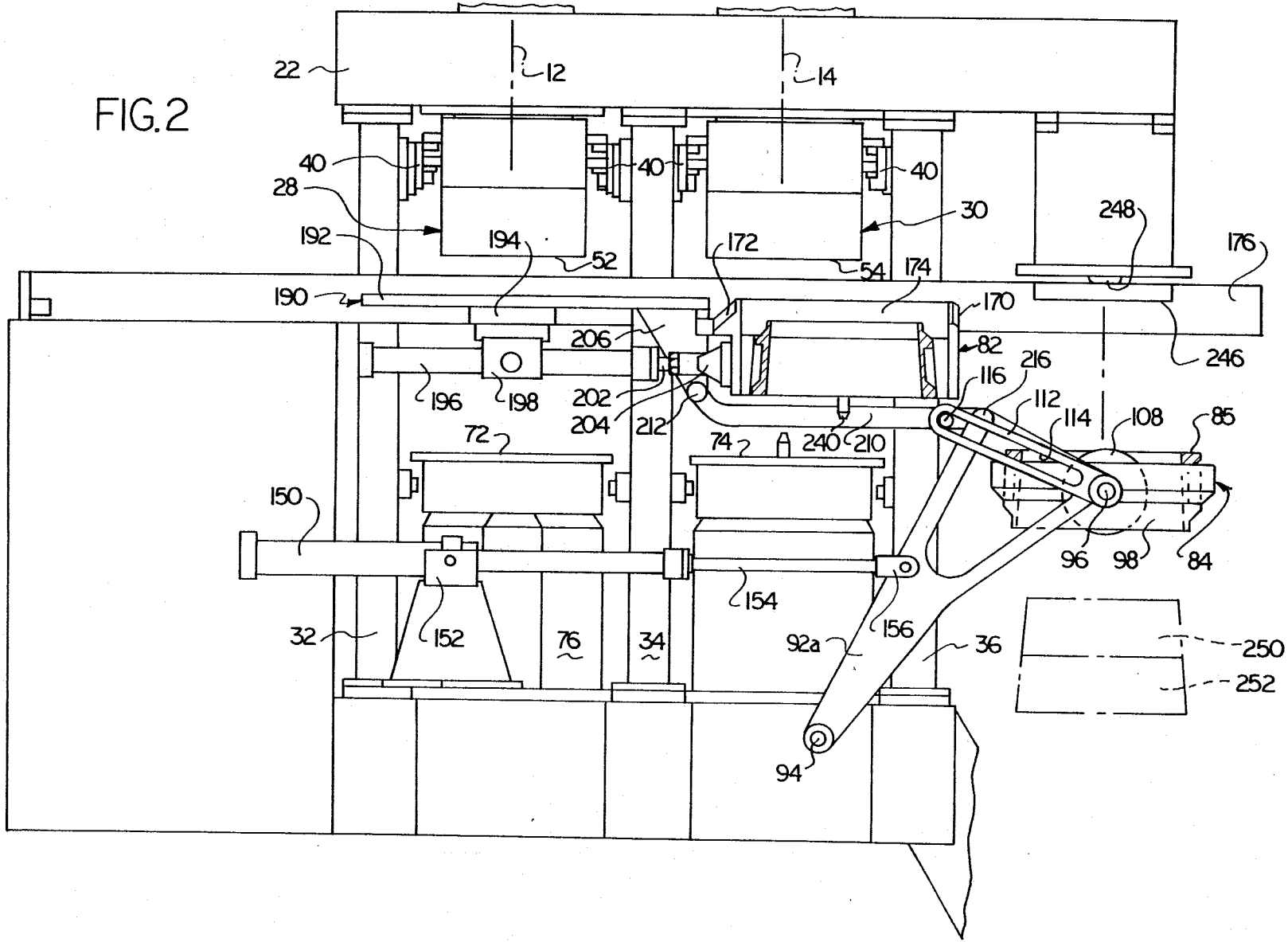
FIG. 2 is a view similar to FIG. 1 and showing flask holders moved from molding stations toward an assembly and stripping station.

The support means for the drag flask holding means 84 includes link means 92 pivotally mounted at its lower end on a pivot axis 94 for swinging movement between the positions 92 and 92*a* of FIGS. 1 and 2. The upper end of the link means 92 has a pin 96 rotatably extending therethrough. The inner end of the pin 96 extends through a suitable hole in a sidewall 98 of the cage defining the drag flask holding means 84. A suitable thrust washer or the like 102 (FIG. 6) is secured to the inner end of the pin 96 and the pin is suitably fixed against rotation relative to the drag flask holding means 84. A spacer sleeve or the like 106 is positioned between a sidewall 98 of the drag flask holding means and a circular cam disc 108. The cam disc 108 is suitably secured to the link means 92 against rotational or longitudinal movement relative thereto by being bolted to a flange 110 on the link means 92. The pin 96 extends rotatably through the cam disc 108. Follower means in the form of an elongated follower link 112 is suitably secured to the outer end of the pin 96 against rotational and longitudinal movement relative thereto. The follower link 112 has an elongated longitudinal slot 114 therein receiving roller 116 fixed to upright frame member 36. The follower roller 116 is located below the pin 96 in all positions of the link means 92.

Figure 6:
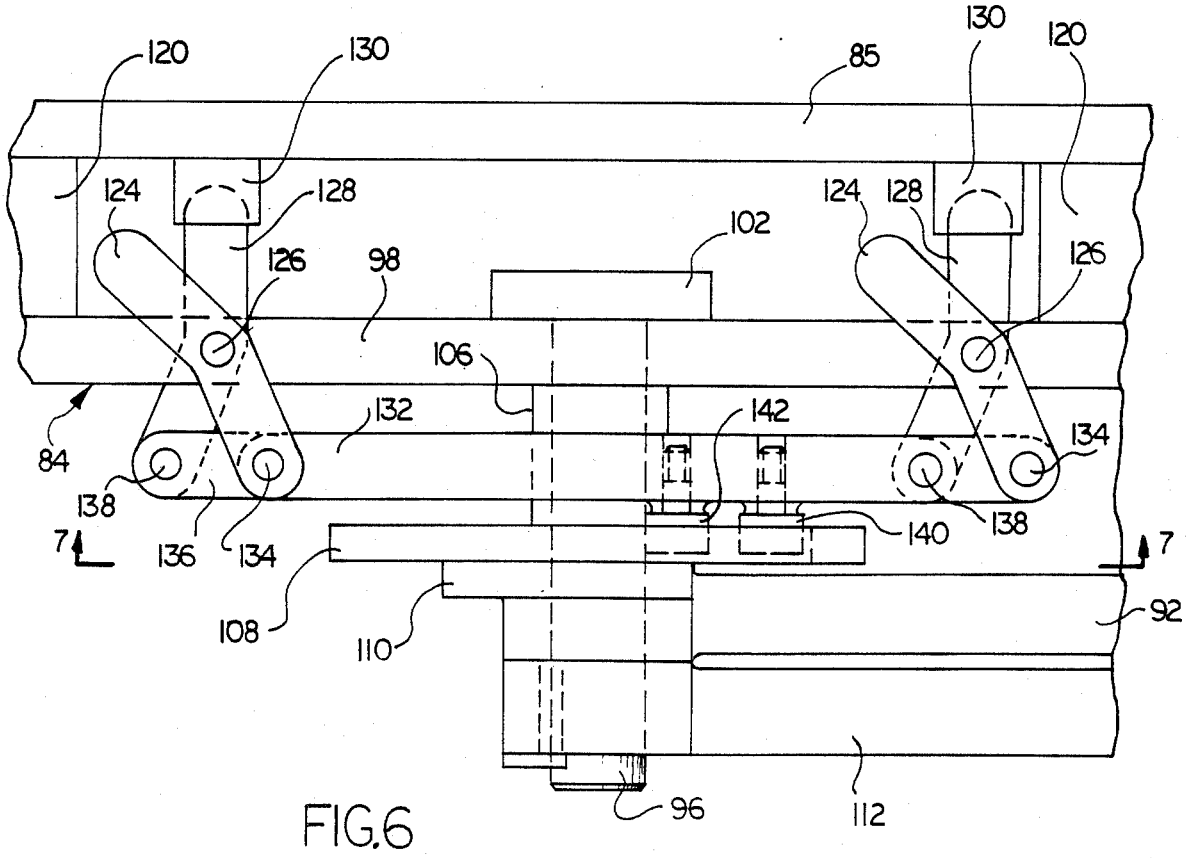
FIG. 6 is a partial plan view taken generally on the line 6—6 of FIG. 5.

In FIG. 6, one sidewall 98 of the drag flask holding means 84 is illustrated. It will be recognized that the cage or holding means may be in the form of a generally rectangular frame having four such walls 98, with the sidewall opposite from the sidewall 98 having the other link means 92 connected thereto in the same manner as described with reference to FIG. 6. The drag flask 85 may have suitable outwardly extending projections generally indicated at 120 for engaging the inner surfaces of the holding means sidewalls and approximately centering the flask therein.

Movable flask rests are provided on the drag flask holding means 84 for movement between a flask supporting position and a flask releasing position. Rest operating means is also provided for moving the rests between their flask supporting and releasing positions in response to swinging movement of the link means 92. In the arrangement shown in FIG. 6, the flask rests are in the form of upper fingers 124 pivoted on vertical axes 126 to the holding means sidewall 98, and lower fingers 128 pivoted to the holding means sidewall 98 on the same pivot axes 126. It will be recognized that the sidewall (not shown) of the holding means 84 opposite and parallel to the sidewall 98 has corresponding support fingers and an operating mechanism associated therewith.

An upper connecting link 132 is connected with the upper fingers as by pins 134. A lower connecting link 136 is connected with the lower fingers 128 as by pins 138. The upper and lower fingers 124, 128 have holes therein receiving the pins 134, 138 for movement between the pins and fingers during pivotal movement of the fingers about the fixed pivot axes 126.

Figure 7:
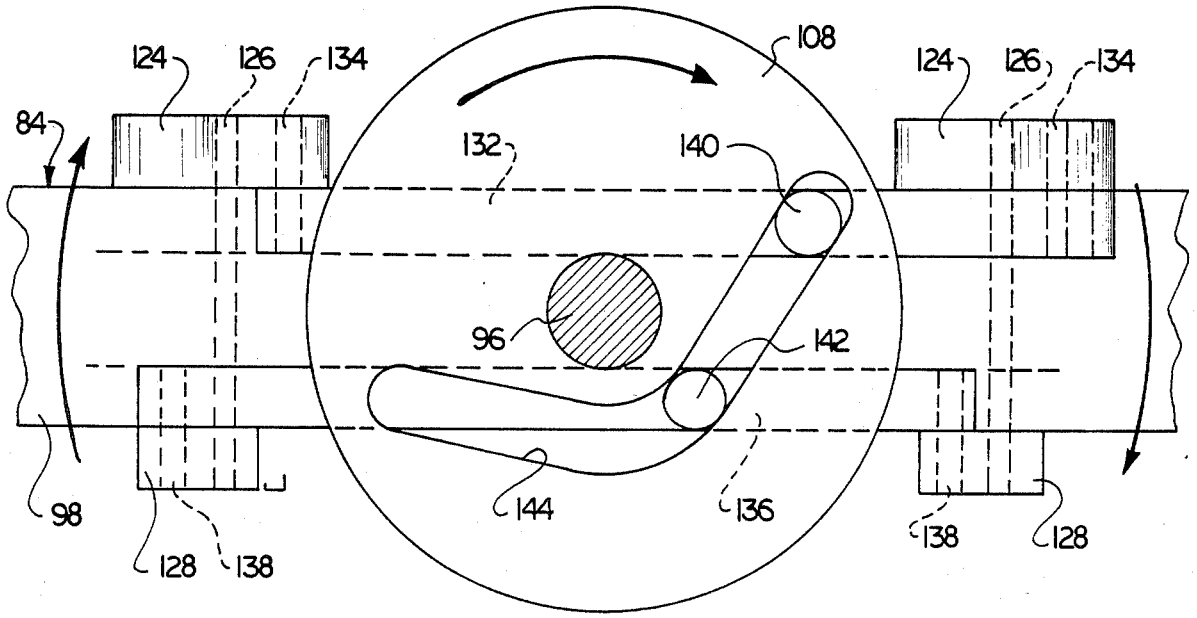
FIG. 7 is a partial cross-sectional elevational view taken generally on line 7—7 of FIG. 6.
Figure 8:
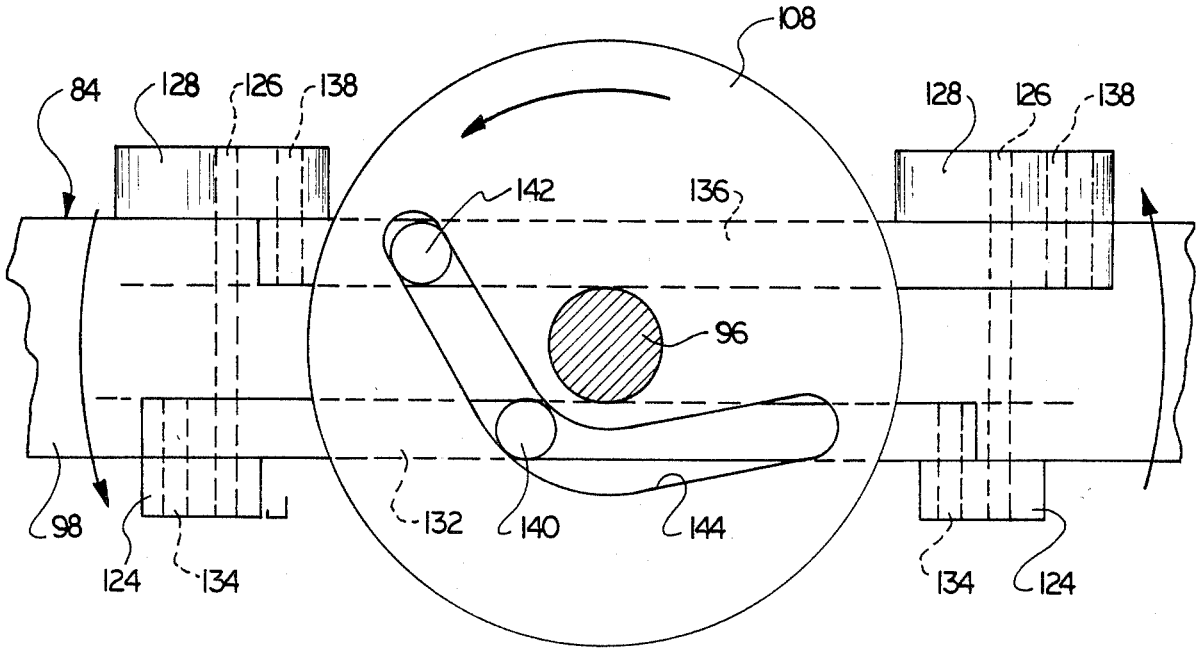
FIG. 8 is a view similar to FIG. 7 and showing the parts in a rotated position.

With reference to FIGS. 6–8, the upper finger connecting link 132 has a cam follower roller 140 attached thereto and the lower finger connecting link 136 has a cam follower roller 142 connected thereto. An arcuate cam slot in the cam 108 is generally indicated at 144 and receives the rollers 140, 142.

The drag flask 85 has four outwardly extending projections 130 thereon for cooperation with the fingers 124, 128. When the drag flask holding means 84 is supported at the drag molding station 14 as shown in FIG. 1, the fingers 124, 128 are located in FIGS. 4, 6 and 7, with the lower fingers 128 being in their flask supporting positions having flask projections 130 resting thereon, and with the upper fingers 124 in their flask releasing positions. Thus, the drag flask 85 is free to move upwardly off from the lower support fingers 128 when the sand is dropped into the drag flask, prejolted and then simultaneously jolt-squeezed.

Power means for swinging the link means 92 may take many forms and is shown as a fluid cylinder 150 having its cylinder portions suitably pivotally connected as at 152 with the apparatus support frame, and having its rod 154 suitably pivotally connected as at 156 with the link means 92. The cylinder 150 includes a conventional viscous oil cylinder to smooth out abrupt movement of the cylinder.

Upon operation of the power means 150, the link means 92 swings from the position of FIG. 1 to the position of FIG. 2 for transferring the drag flask holding means 84 from the drag molding station 14 to the assembly and stripping station 16. With the drag flask holding means 84 in the position of FIG. 1, the cam disc 108 is in the position of FIG. 7. Upon swinging movement of the link means 92 to the position 92*a* of FIG. 2, the link means 92 travels through an arc of approximately 53°. The cam disc 108 is fixed against rotation relative to the link means 92, with the consequence that the cam disc 108 is effectively rotated approximately 53° about the axis 94 of the link means 92. Thus, when the link means 92 swings from the position of FIG. 1 to the position of FIG. 2, the cam disc 108 is effectively rotated to the position of FIG. 8 and the cam slot 144 is moved clockwise approximately 53° from the position of FIG. 7.

At the same time that the link means 92 is swinging clockwise about the pivot axis 94, the follower means defined by the follower link 112 is also rotating the pin 96 and the drag flask holding means 84 clockwise relative to the link means 92 and the cam disc 108. The fixed follower operating means defined by the follower roller 116 received in the follower link slot 114 causes the link to rotate clockwise and to rotate the drag flask holding means 84 clockwise through an angle of approximately 180°. Thus, the drag flask holding means is rotatably inverted in moving from the drag molding station 14 to the assembly and stripping station 16.

With reference to FIGS. 7 and 8, the drag flask holding means 84 rotates clockwise faster than the cam disc 108. Thus, the drag flask holding means is completely inverted and the positions of the fingers 124, 128 are completely reversed by cooperative action of the cam means 144 and the cam follower means 140, 142. When the fingers 124, 128 are considered flask rests, the cam slot 144 and cam rollers 140, 142 may be considered rest operating means automatically operative in respose to movement of the drag flask holding means from the drag molding station 14 to the assembly and stripping station 16 for moving the rests between their flask supporting and releasing positions. In the position of FIG. 8, the fingers 128 become the upper fingers and are located in their drag flask releasing position, while the fingers 124 become the lower fingers for supporting the drag flask at the assembly and stripping station 16. This arrangement allows free upward movement of the drag flask relative to the drag flask holding means 84 at both the drag molding station 14 and at the assembly and stripping station 16.

The cope flask holding means 82 may be in the form of a generally rectangular frame including front and rear plates 170, 172 secured between opposite side plates, only one of which (174) is shown in FIGS. 1 and 4.

With the reference to FIG. 4, opposite elongated support rails 176 are mounted on the apparatus frame, and are elongated in a direction perpendicular to the plane of FIG. 4. A plurality of support rollers 178 are mounted on horizontal axes to the rails 176 and are spaced apart in a direction perpendicular to the plane of the paper. The cope flask holding means 82 has a plurality of guide rollers 180 mounted on vertical axes and spaced apart in a direction perpendicular to the plane of FIG. 4. The guide rollers 180 engage the rails 176 for maintaining transverse alignment and maintaining sliding reciprocating movement of the flask holding means 82. Only one side of the holding means is shown in FIG. 4, and it will be recognized that the side member opposite side member 174 is similarly supported on the opposite side of the flask 83. The side members on the cope flask holding means 82 include inward extensions 182 having vertically adjustable pins 184 secured thereto for reception in suitable sockets on outwardly extending flask projections 186.

A slideable carriage 190 (FIG. 1) is positioned to the rear of cope flask holding means 82. That is, the carriage 190 is on the opposite side of the cope flask holding means 82 from the drag flask holding means 84. The carriage 190 includes opposite plates, only one of which is shown at 192 in FIG. 4. The opposite plates 192 are connected as by transverse plates 194 to which power means in the form of a fluid cylinder 196 is connected by having its cylinder portion pivotally secured to a bracket 198. Rod 202 of the cylinder 196 is conected as at 204 with the rear wall 172 of the cope flask holding means 82.

Connecting members 206 extend downwardly from the plate 192 and have connecting links 210 pivotally connected thereto as at 212. The opposite ends of the connecting links 210 are pivotally connected at 216 with the link means 92. The pivot connection 216 is located below the pin 96 as shown in FIG. 1.

Upon operation of the fluid cylinder 150 for swinging the link means 92 from the position of FIG. 1 to the position of FIG. 2, a pulling force is transmitted to the connecting link 210 to the carriage 190 for pulling the carriage 190 and its associated cope flask holding means 82 to an intermediate position shown in FIG. 2, wherein the cope flask holding means 82 is located intermediate the cope molding position 12 and the assembly and stripping station 16. The power means 196 is operated after coring for extending the rod 202 for moving the cope flask holding means 82 to the right away from the carriage 190 for locating the cope flask holding means 82 in a position vertically aligned above the drag flask holding means 84 at the assembly and stripping station 16.

With reference to FIGS. 1 and 4, a bottom board 220 is supported across spaced apart support channels 222. A fluid telescoping cylinder 224 positioned between the channel supports 222 is vertically aligned with the cope and drag flask holding means at the assembly and stripping station 16. The telescoping cylinder 224 comprises a pair of cylinder members and a pair of fluid chambers, as is conventional. Fluid, such as air is introduced into the chambers and the pair of cylinders are extended thereby. The telescoping cylinder 224 has a support member 226 attached thereto. Guide rods 228 on the support member 226 extend through suitable guide holes in flanges 230 on the housing of the telescoping cylinder 224. A table 234 is supported on the support member 226 by compressible springs 236. Ears 235 extend upwadly of the support member 226, outwardly of the table 234 and have pins 238 extending upwardly therefrom.

Figure 3:
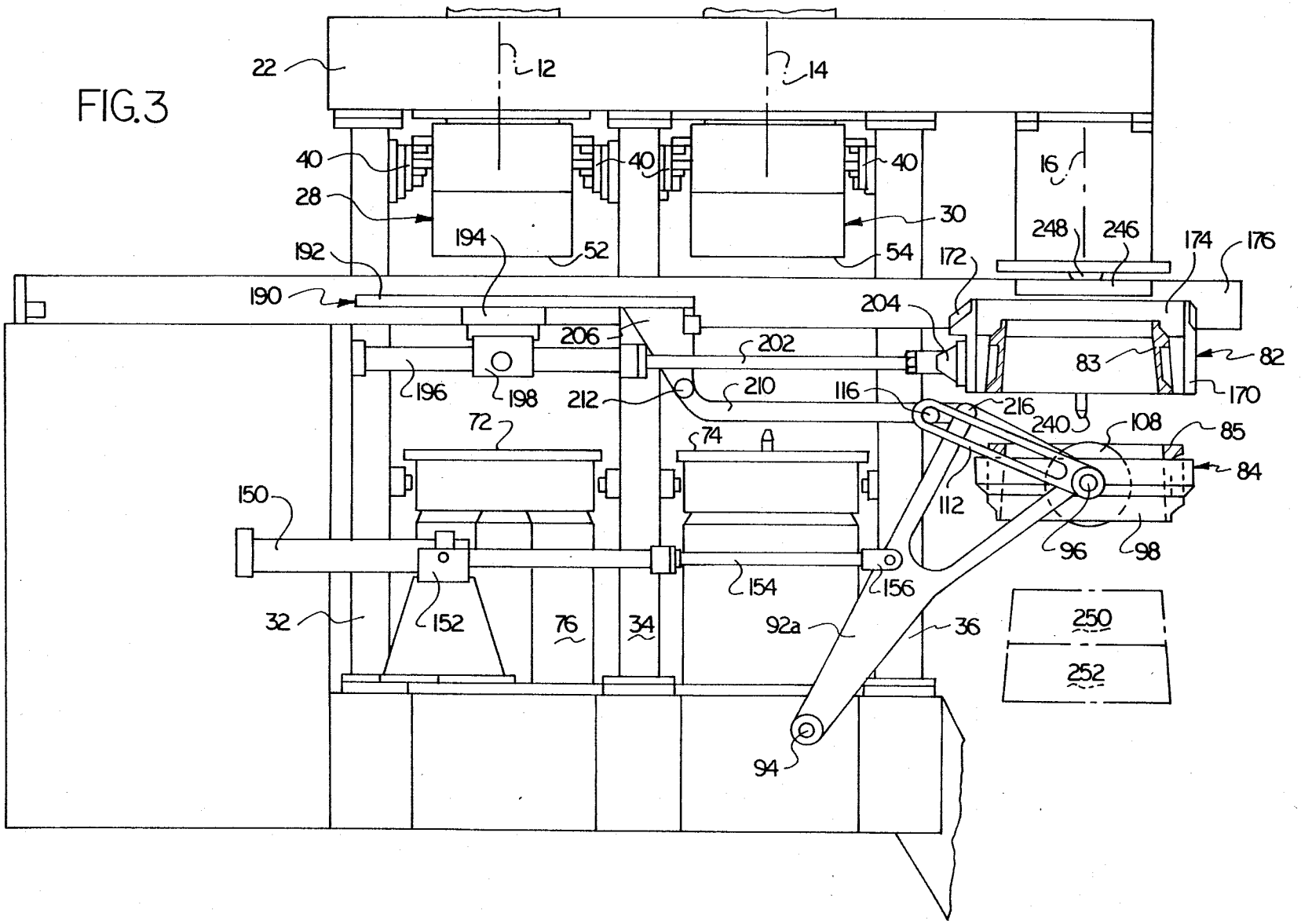
FIG. 3 is a view similar to FIGS. 1 and 2, and showing cope and drag flasks moved from molding stations into vertical alignment at a stripping station.

When the drag flask 85 is positioned at the drag molding station 14, it has an opening which decreases in cross sectional area from its top to its bottom. When the drag flask 85 is inverted at the assembly and stripping station 16, the drag flask 85 increases in cross sectional area from its top to its bottom as shown in FIG. 4. With the cope and drag flask holding means vertically aligned at the assembly and stripping station 16, as generally indicated in FIGS. 3 and 4, telescoping cylinder 224 is operated for elevating the support member 226 and this causes the table 234 to engage the bottom board 220 for lifting it into engagement with the sand mold contained within the drag flask 85. Continued upward movement of the support member 226 under power supplied by the telescoping cylinder 224 lifts the drag flask 85 from the support fingers 124 and moves them upwardly into engagement with the cope flask 83. The upwardly extending pins 238 on the support member 226 are receivable in suitable alignment sockets in the drag flask 85. The cope flask 83 has downwardly extending guide pins 240 receivable in upwardly opening guide sockets in the drag flask 85. Upward movement of the assembled cope and drag flasks 83, 85 containing sand molds continues until the sand mold within the cope flask 83 engages board 246 (FIGS. 1–3). The board 246 is mounted on a swivel 248 for limited angular movement out of a horizontal plane.

When the sand within the cope flask 83 engages the board 246, further upward movement of the support member 226 moves the cope and drag flasks 83, 85 upwardly, while the pressure exerted by the board 246 on the sand molds and the spring supported table 234 causes the springs 236 to compress further for stripping the cope and drag molds 250, 252 from the flasks 83, 85. The telescoping cylinder 224 is then operated to lower the support member 226 and the table 234 back down to the position shown in FIGS. 1 and 4. The cope flask 83 will come back down to rest on the support 184 and the drag flask 85 will come to rest on the fingers 124, while the assembled cope and drag molds 250, 252 continue their downward movement until the bottom board 220 engages the support channels 222. The molds and the bottom board can then be transferred by moving channels 222, a conveyor, rollers, or a pusher if so desired. The fluid cylinders 196 and 150 are then sequentially operated for moving the cope and drag holding means 82, 84 from the position of FIG. 3 back to the position of FIG. 1 in order to form additional cope and drag molds.

In operation the entire apparatus makes it possible to simultaneously form both drag and cope mold sections and to prejolt and jolt-squeeze both. The cope and drag holding means 82, 84 are located at the cope and drag molding stations 12, 14 as shown in FIG. 1. Carriages 28, 30 are moved longitudinally for aligning their chutes with the sand hoppers 18, 20 while the prejolt and jolt-squeeze cylinders 76, 78 are elevated for lifting the flasks 83, 85 and closing the bottoms thereof. A measured amount of sand is then supplied to each flask and the cylinders 76, 78 are operated to apply a jolting movement called prejolt to settle and precompact the sand in the flask. Thereafter, the cylinders 76 and 78 simultaneously apply squeezing and jolting movement to the sand against the squeeze boards 52, 54. The cylinders 76, 78 then are lowered to lower the cope and drag flasks 83, 85 back into supporting relationship with the holding means 82, 84. Next, the cylinder 150 operates to swing the link means 92 and move the drag flask holding means from the drag molding station 14 to the assembly and stripping station 16. During this movement, the drag flask holding means is also rotatably inverted by cooperation of the follower link 112 and follower roller 116. In addition, the fingers 124, 128 reverese positions so the drag flask is free to move upwardly at either the station 14 or 16 while being supported from below. As the drag flask holding means moves from the drag molding station 14 to the assembly and stripping station 16, the cope holding means is pulled by the connecting line 210 to an intermediate position shown in FIG. 2. After cores are placed in the drag mold, the cylinder 196 is then operated to move the cope flask holding means from the intermediate position of FIG. 2 to the position of FIG. 3 in vertical alignment above the drag flask holding means 84. The telescoping cylinder 224 is then operated for assembling and stripping the molds, and then lowering the assembled molds while depositing the respective flasks on their respective holding means for transferring back to the molding station.

With the holding means 82, 84 in the position of FIG. 2, there is adequate clearance for providing ease of inserting cores into the sand cake molds carried thereby and to faciliate green sand projections.

I claim:

1. An apparatus comprising a cope molding means for molding a cope mold section, a drag molding means for molding a drag mold section, and a stripping means for removing said cope and drag mold sections from their respective flasks and for assembling said cope and drag mold sections, said cope molding means, said drag molding means and said stripping means each being laterally spaced from each other and arranged in a side-by-side relationship such that the centerlines of said cope molding, drag molding and stripping means lie in a common vertical plane, said drag molding means being located between said cope molding means and said stripping means, said cope and drag molding means substantially simultaneously molding said cope and drag mold sections, a cope flask holding means and a drag flask holding means for holding a cope flask and a drag flask respectively, and a support means for supporting said cope flask holding means and said drag flask holding means, respectively, and for moving said cope flask holding means laterally along a straight path and said drag flask holding means laterally and downwardly along an arcuate path from said cope molding means and said drag molding means, respectively, into vertical alignment at said stripping means to effect alignment of said cope and drag mold sections at said stripping means, said straight path and said arcuate path lying in said common vertical plane, and said support means effecting inverting of said drag flask holding means while moving said drag flask holding means from said drag molding means to said stripping means.

2. The apparatus of claim 1 wherein said support means moves said cope and drag flask holding means simultaneously for positioning said cope flask holding means in an intermediate position between said cope molding means and said stripping means upon movement of said drag flask holding means to said stripping means, said apparatus further including means for laterally moving said cope flask holding means from said intermediate position to said stripping means.

3. The apparatus of claim 1 wherein said drag flask holding means includes movable upper and lower flask rests movable between flask supporting and releasing positions, said upper flask rests being in said releasing position and said lower flask rests being in said supporting position when said drag flask holding means is at said drag molding means, said rests being in reversed positions when said drag flask holding means is at said stripping means, and rest operating means for moving said rests between said releasing and supporting positions in response to movement of said drag flask holding means between said drag molding means and said stripping means.

4. The apparatus of claim 3, wherein said flask rests comprise pivoted fingers having cam followers associated therewith, said support means including cam means cooperating with said cam followers for moving said fingers between said flask supporting and releasing positions in response to movement of said support means.

5. The apparatus of claim 1 wherein said cope and drag holding means support cope and drag flask for upward movement relative thereto at said stripping means.

6. The apparatus of claim 1 wherein said support means includes a link means connected to said drag flask holding means for moving said drag flask holding means in an arcuate path between said drag molding means and said stripping means.

7. The apparatus of claim 1 wherein said support means includes a movable drag support for said drag flask holding means and support guides along which said cope flask holding means moves, a carriage movable along said guides and being positioned adjacent said cope flask holding means on the opposite side thereof from said drag flask holding means, said drag support being connected with said carriage for movement thereof with said drag support means, and a fluid cylinder connected between said carriage and said cope flask holding means for moving said cope flask holding means relative to said carriage.

8. The apparatus of claim 1 wherein said cope and drag molding means includes means for substantially simultaneously prejolting cope and drag flasks respectively, and then substantially simultaneously jolt-squeezing said cope and drag flasks respectively.

* * * * *